United States Patent [19]

Soderberg

[11] Patent Number: 4,645,007

[45] Date of Patent: Feb. 24, 1987

[54] TUBING DRAIN VALVE

[75] Inventor: Paul B. Soderberg, Houston, Tex.

[73] Assignee: Soderberg Research & Development, Inc., Houston, Tex.

[21] Appl. No.: 618,469

[22] Filed: Jun. 8, 1984

[51] Int. Cl.[4] ..... E21B 34/10; E21B 34/14

[52] U.S. Cl. ..... 166/374; 166/323; 166/332; 166/386; 251/14; 251/114

[58] Field of Search ..... 166/319, 320, 321, 323, 166/332, 373, 374, 386; 251/14, 62, 63.5, 111, 114

[56] References Cited

U.S. PATENT DOCUMENTS

| | | | |
|---|---|---|---|
| 3,794,112 | 2/1974 | Hill | 166/321 X |
| 3,973,586 | 8/1976 | Hill et al. | 166/321 X |
| 4,257,484 | 3/1981 | Whitley et al. | 166/321 X |
| 4,331,315 | 5/1982 | Geisow | 166/321 X |
| 4,429,747 | 2/1984 | Williamson, Jr. | 166/321 |
| 4,452,310 | 6/1984 | Pringle et al. | 166/321 X |

FOREIGN PATENT DOCUMENTS

| | | | |
|---|---|---|---|
| 2080365 | 2/1982 | United Kingdom | 166/321 |

*Primary Examiner*—James A. Leppink
*Assistant Examiner*—John F. Letchford
*Attorney, Agent, or Firm*—Browning, Bushman, Zamecki & Anderson

[57] ABSTRACT

The present invention discloses a tubing drain valve suitable for use in a borehole and a method for operating the disclosed valve. This device is particularly useful in a production pipe string where it provides a convenient apparatus and method for draining production fluid from the string in order to facilitate a variety of activities. More particularly, the present invention relates to a tubing drain valve actuated to its open position by a force developed across the working surfaces of a movable piston by the pressure in the interior of the production string and actuated to its closed position by a mechanical device. Preferably, the tubing drain valve of the present invention further comprises structure to bias the valve to its closed position and structure to bias the valve in its open position. The valve of the present invention is actuated by overcoming the appropriate biassing forces.

21 Claims, 9 Drawing Figures

FIG. 1
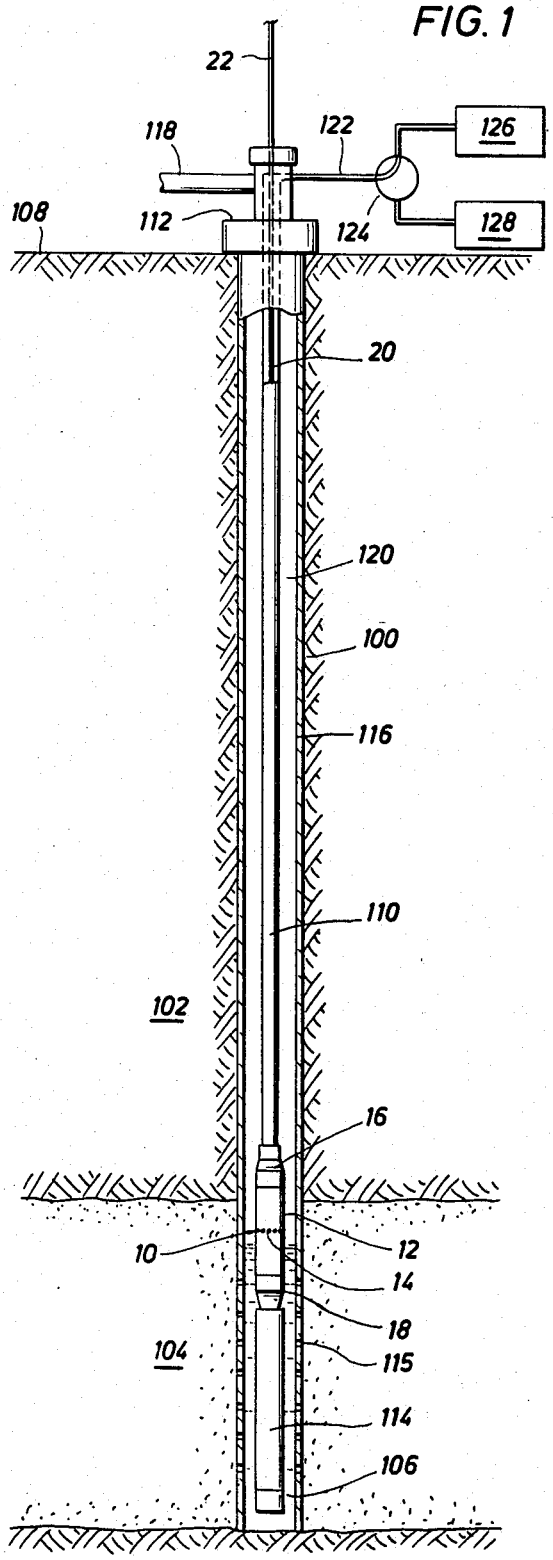
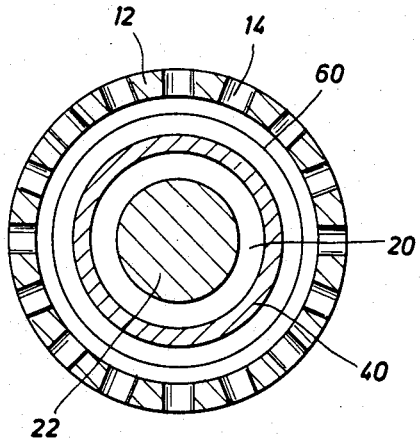
FIG. 4

FIG. 5
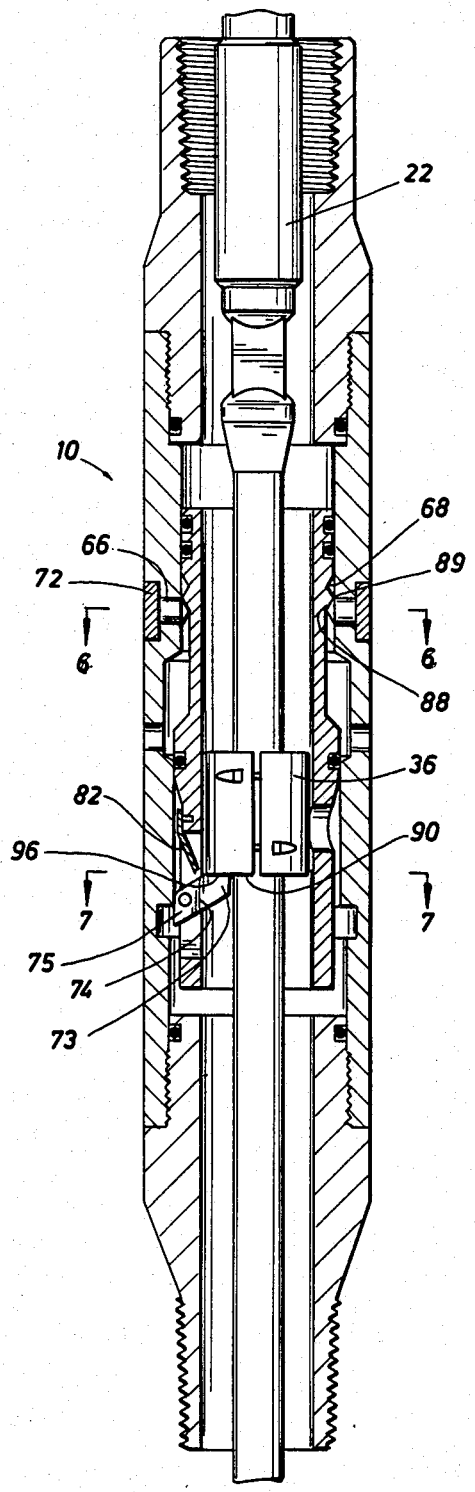
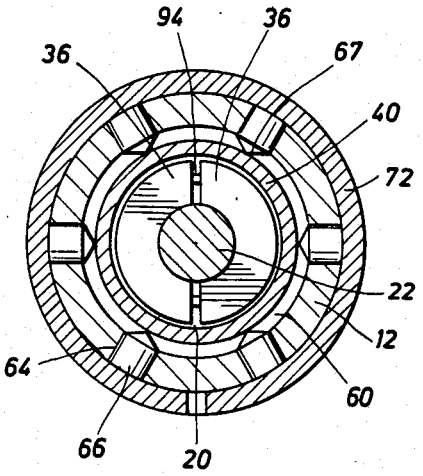
FIG. 6
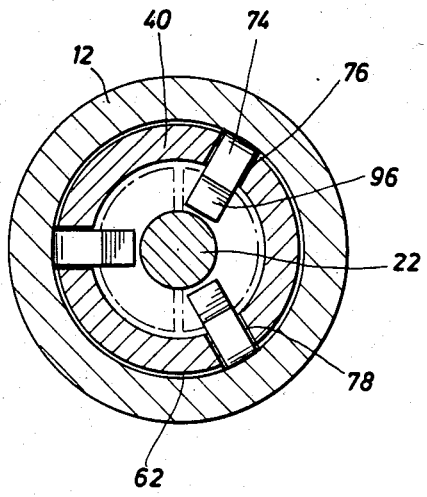
FIG. 7

FIG. 8
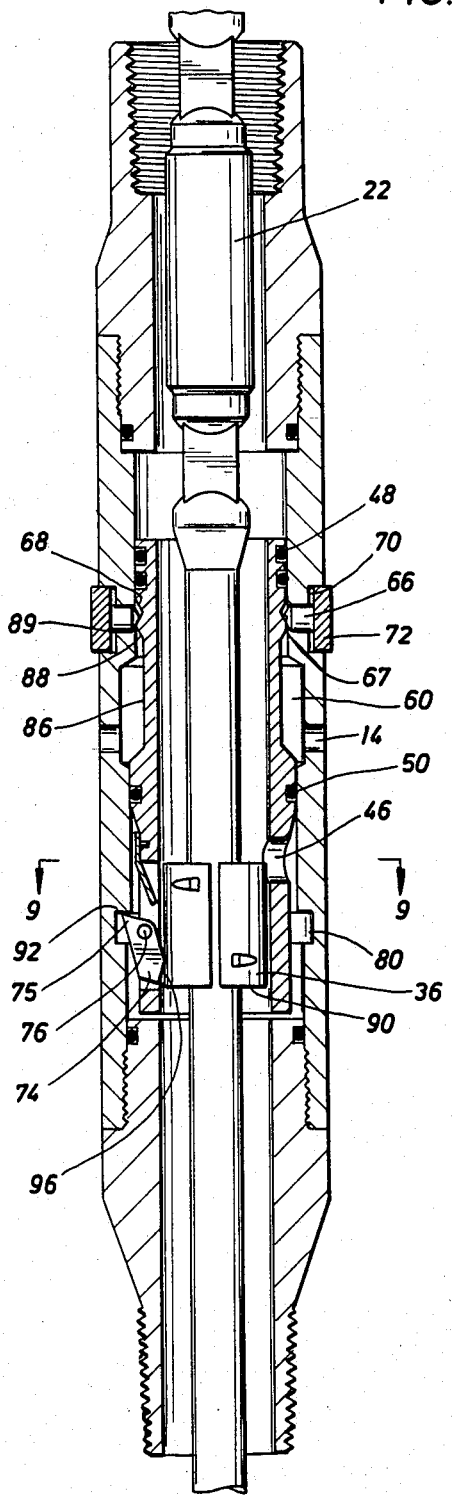
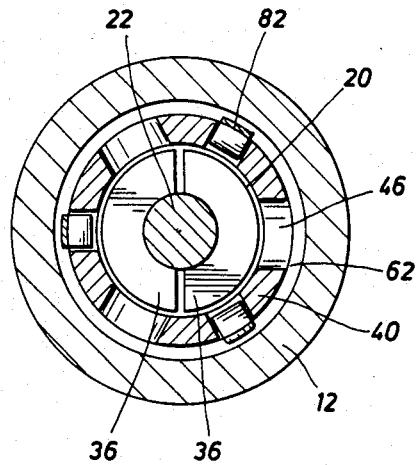
FIG. 9

TUBING DRAIN VALVE

BACKGROUND OF THE INVENTION

1. Field of the Invention

The present invention generally relates to a tubing drain valve suitable for use in a borehole and a method for operating the disclosed valve. The present invention is particularly useul in a production string where it provides a convenient apparatus and a method for draining production fluid from the string in order to facilitate routine activities, e.g., removal of the downhole pump, injection of chemicals into the producing formation, injection of hot fluid to dissolve paraffin deposited in the production tubing and the like. More particularly, the present invention relates to a tubing drain valve actuated to its open position by application of a force developed across a movable piston by the pressure in the interior of the production string coupled with positive closing by mechanical means.

2. Description of the Background

It is often desirble to have a drain valve located in the wall of a borehole tubing string. It is particularly desirable to have a tubing drain valve located in a production string for a variety of reasons. For example, the efficiency of production strings is often decreased by the deposit of paraffin, wax and similar substances on the interior of the string as the string rises through lower temperature zones from a deep, high temperature production zone. It is necessary to remove these deposits in order to maintain the efficiency of the production string. Present methods for removing such deposits employ hot water or stream which is generally forced down the annulus between the production string and the borehole casing. The hot water or steam enters the production string through the downhole pump and returns to the surface through the string where the elevated fluid temperature slowly dissolves the deposits. Because of the long and circuitous path to the zone of interest, fluid reaching the zone of interest is often at a temperature significantly lower than the injected fluid. It is often desirble to inject the producing zone with a variety of chemicals to increase or aid production. These chemicals also are injected by the previously described method for injecting steam or hot water. These methods suffer from the disadvantage that excessive quantities of fluids and chemicals are required because the injection is indirect through the annulus. Alternatively, dedicated, small diameter injection tubing is employed to directly inject chemicals into the production zone.

It is often necessary to pull the production pump for routine maintenance, repair, replacement and the like. Many presently employed systems require that the production string be pulled in order to pull the production pump. This is necessary because the production pump will not pass through the interior of the production string due to size differential or obstructions in the string. Accordingly, the pulling of the production pump is quite time consuming and expensive. Even where the pump will pass through the production string, present systems for pulling the pump must overcome the vast weight of the production fluid in the string. This weight is substantial and reaches many tons in deep wells where the fluid column is many thousands of feet or even several miles in height.

In an attempt to solve some of the above problems, others have proposed a variety of valves suitable for use in a borehole production string. For example, valves which open when the pressure within the tubing exceeds a pre-determined pressure have been proposed. Such valves permit fluid communication between the interior of the production string and the annulus at the valve location. These valves are useful for draining the production fluid above the valve location and for injecting chemicals into the borehole at the valve location only if the valve remains open after its initial opening. It is still necessary to pull the production string in order to close these valves. Alternatively, other check valves, e.g., spring loaded valves, operable above a pre-determined pressure permit injection of fluids into a borehole at the valve location, but fail to provide a means for draining fluid from the production string.

Accordingly, there has been a long felt but unfulfilled need within the industry for a tubing drain valve which is both opened and closed conveniently and reliably from the surface. This valve must also be easily maintained in the open position in order to permit drainage of the production string. Further, this valve must be positively closable from the surface. Finally, this valve should not provide any obstruction in the interior of the tubing string to the removal of the production pump.

SUMMARY OF THE INVENTION

The present invention provides a new and improved drain valve and method of operating the same, particularly useful in a borehole pipe string. This device and method provide a valve actuated to its open position by a force developed across the working surfaces of a movable piston and positively actuated to its closed position by mechanical means. The valve of the present invention does not restrict removal of objects through the pipe string when in the open position, but includes engagement surfaces which actuate the valve to its closed position when engaged by an object being inserted into the pipe string.

A tubing drain valve in accord with the present invention comprises a passage between the interior and the exterior of a sub suitable for incorporation within a borehole pipe string together with a valve means therein to open and close the passage. The valve means is actuated to its open position by a force developed across the working surfaces of a movable piston and actuated to its closed position by a mechanical means. The valve is preferably actuated to its open position when the pressure in the interior of the sub exceeds a predetermined pressure. In a presently preferred embodiment, the valve comprises a tubular piston sealably and slidably positioned within the sub and having a port for cooperation with the passage of the sub. The valve further comprises a means for biassing the piston to its closed position, preferably provided by a cooperating boss and detent on the piston and sub urged together by a cooperating C-spring. In the presently preferred embodiment, the valve further comprises a means for biassing the valve in its open position, conveniently provided by a similar boss, detent and C-spring arrangement. In the presently preferred embodiment, the valve further includes a pivotally mounted dog engageable on a first arm by an actuating device insertable through the interior of the pipe string and engaging with a second arm a surface of the sub for urging the valve to its closed position. The valve is conveniently actuated to its closed position by an engaging device attached to the sucker rods operating the downhole pump.

The method of the present invention comprises applying a first biassing force to maintain the valve in its closed position, applying a sufficient force to the valve piston to overcome the biassing force and to actuate the valve to its open position and applying a sufficient force by mechanical means to the piston to actuate the valve to its closed position. The biassing force is applied by a cooperating boss, detent and C-spring arrangement as described above. Further, the presently preferred method of the present invention comprises applying a biassing force to maintain the valve in its open position. This second biassing force is conveniently applied by means similar to that employed for applying the first biassing force. In the presently preferred embodiment, the opening force is produced by increasing the pressure in the interior of the piston and sub to a pre-determined pressure to develop the required force across the working surfaces of a movable piston. Finally, the presently preferred method comprises applying a sufficient force to overcome the second biassing force and to actuate the valve to its closed position by lever means. A further extension of the method of the present invention comprises injecting a fluid, e.g., hot water, steam or a variety of chemicals, into the borehole through the open valve.

The device and method of the present invention solve the long felt but unfulfilled need for an effective tubing drain valve, conveniently operable from the surface and providing a positively opened and closed valve. Further, the device of the present invention does not impede removal of objects from the pipe string. Such a device permits the production fluid to be conveniently drained from the production string when necessary and permits injection of fluids, e.g., hot water, steam and chemicals, directly into the production tubing at the surface and into the formation through the drain valve. These and other meritorious features and advantages of the present invention will be more fully appreciated from the following detailed description and claims.

BRIEF DESCRIPTION OF THE DRAWINGS

Other features and intended advantages of the present invention will be more readily apparent by the references to the following detailed description in connection with the accompanying drawings wherein:

FIG. 1 is a representation of a borehole having a sub including a tubing drain valve located near the top of a producing formation;

FIG. 4 is a cross-sectional illustration of a tubing drain valve in accord with the present invention through the plane 4—4 of FIG. 2;

FIG. 5 is a cross-sectional illustration of a tubing drain valve in accord with the present invention wherein the engaging device on a sucker rod is moving the valve downward toward its closed position;

FIG. 6 is a cross-sectional illustration of a tubing drain valve in accord with the present invention through the plane 6—6 of FIG. 5;

FIG. 7 is a cross-sectional illustration of a tubing drain valve in accord with the present invention through the plane 7—7 of FIG. 5;

FIG. 8 is a cross-sectional illustration of a tubing drain valve in accord with the present invention wherein the valve is being sprung to its closed position by the biassing means; and FIG. 9 is a cross-sectional illustration of a tubing drain valve in accord with the present invention through the plane 9—9 of FIG. 8.

Figure 2:
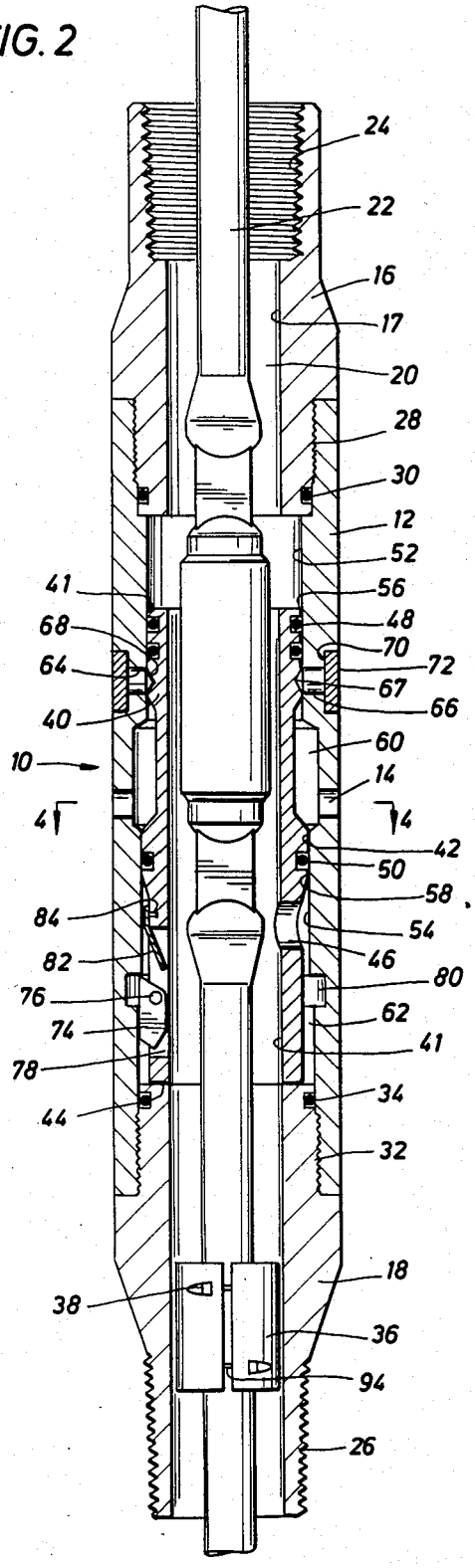
FIG. 2 is a cross-sectional illustration of a sub including a tubing drain valve in accord with the present invention in the closed position.

While the invention will be described in connection with a presently preferred embodiment, it will be understood that it is not intended to limit the invention to this embodiment. On the contrary, it is intended to cover all alternatives, modifications and equivalents as may be included in the spirit of the invention as defined in the appended claims.

DETAILED DESCRIPTION OF THE PREFERRED EMBODIMENT

FIG. 1 illustrates a pipe string 110 disposed within a borehole 100 through a formation 102 to the producing zone 104. The pipe string 110 comprises a plurality of tubular members interconnected and suspended from the surface 108 to the producing zone 104. At the lower end of the pipe string 110 is a production pump 114 submerged within the production fluid 106. The production fluid 106 enters the annulus 120 through perforations 115 in the casing 116. Although the illustrated borehole is cased, as is typical in producing wells, it is not necessary that the borehole be cased. The downhole pump 114 is actuated by a conventional string of sucker rods 22 passing through the interior 20 of the pipe string 110. This string of sucker rods 22 is operable by any conventional well head device, e.g., a grasshopper pump. Production fluids are pumped to the surface 108 through a well head 112 and appropriate pipes 118 to a conventional storage tank, pipeline or the like (not illustrated).

FIG. 1 illustrates a tubing drain valve sub 10 located within the pipe string just above the downhole pump 114 near the upper limit of the producing zone 104. The tubing drain valve sub 10 comprises a tubular member 12 sealingly engaged between an upper connector 16 and a lower connector 18 in the pipe string. The tubular member 12 includes a plurality of ports or fluid passageways 14 capable of providing fluid communication between the interior 20 of the drain valve sub and the annulus 120 of the borehole. FIG. 1 also illustrates representationally a pressure source 126 connected by pressure tubing 122 and a three-way valve 124 for pressurizing the interior of the pipe string and the tubing valve sub 10. Also illustrated is a fluid source 128 for communicating or injecting a fluid into the pipe string 110 and, optionally, into the formation through the ports 14 of the tubing drain valve sub 10. Those skilled in the art will be aware of many conventional systems for downhole injection of a variety of fluids, e.g., high temperature water, steam, treating chemicals and the like, which may be substituted for the fluid source 128 of the present invention.

Referring now to FIGS. 2–9, with particular emphasis on FIG. 2, a presently preferred tubing drain valve sub 10 in accord with the present invention is illustrated in more detail. The tubing drain valve of the present invention is suitable for use in a borehole pipe string and comprises a sub 10 suitable for incorporation within a borehole pipe string 110. The sub 10 comprises a tubular member 12 suitable for incorporation within a borehole pipe string. The tubular member 12 is threadedly engaged 28 with an upper, annular connector 16 which in turn is threaded 24 for incorporation within a borehole pipe string. Sealing engagement between the tubular member 12 and the upper connector 16 is provided by O-ring seal 30. At its other end, the tubular member 12 is threaded 32 for engagement with a lower, annular connector 18 which in turn is threaded 26 for incorporation within a borehole pipe string. Sealing engagement between the tubular member 12 and the lower connector 18 is provided by O-ring seal 34. The tubular member 12 is characterized by a plurality of ports or passageways 14 capable of providing fluid communication between the interior and exterior of sub 10. In a presently preferred embodiment, a plurality of ports 14 are symmetrically spaced about the sub 10. For example, in FIG. 4 sixteen ports 14 are symmetrically spaced about a plane passing through the central cross section of the tubular member 12.

The tubing drain valve sub 10 further comprises valve means to open and close the ports 14 wherein the valve means is actuated to its open position by a force developed across the working surfaces of a movable, tubular piston 40 and is actuated to its closed position by a mechanical means, conveniently an engaging device 36 attached to a sucker rod 22. A string of conventional sucker rods 22 passes through central bore 20 of the pipe string 110 and the sub 10. It is preferred that the diameter of the interior surface 41 of the piston 40 be at least as great as the diameter 17 of the interior surface of the connectors 16, 18 and the pipe string 110 in order to permit unobstructed passage of objects, e.g. the downhole pump, through the sub 10. Tubular piston 40 is characterized by an exterior 41, 42 adapted for sealing cooperation with the interior 52, 54 of the tubular member 12 such as with O-ring seals 48, 50 on opposite sides of the ports 14. In a presently preferred embodiment, the tubular piston 40 further comprises one or more ports 46 therethrough for cooperation with the ports 14 as through passage 62 and chamber 60 to permit fluid communication from the interior 20 to the exterior 120 of the sub 10.

The tubing drain valve sub 10 further comprises means for biassing the tubular piston 40 to its closed position. The biassing means is conveniently provided by one or more bosses 67 on the tubular member 12 cooperating with one or more detents 68 on the piston 40. In a presently preferred embodiment, the bosses 67 comprise the conical end of a plurality of plugs 66 inserted within bores 64 through the tubular member 12. See FIG. 6 where an arrangement incuding six, symmetrically spaced bosses is illustrated. These bores 64 and bosses 67 are symmetrically located about the tubular member 12 within a groove 70. The plugs 66 are urged inwardly by a C-spring 72 which provides the desired biassing force. The force required to actuate the valve of the present invention to its open position is determined by the strength of the C-spring 72. It is within the ability of those skilled in the art to produce a valve in accord with the present invention which is operable at any desired force by the judicious selection of the C-spring 72. The cooperating detent in the piston 40 is conveniently provided by a circumferential groove 68 shaped to cooperate with the conical bosses 67 on the plugs 66.

The valve of the present invention further comprises means for biassing the piston 40 in its open position. Such means is again conveniently provided by a cooperating boss and detent arrangement. In a presently preferred embodiment, the boss 67 and C-spring 72 arrangement described above cooperate with a second detent, provided by a second groove 86 located on the exterior surface of the piston 40 below the first detent 68. This second groove 86 need not be a narrow groove like first groove 68, but may be characterized by a substantial width along the longitudinal axis of the piston 40. In the open position, the piston 40 need not be biassed to a specific position but need only be biassed to a position which permits fluid communication from the interior 20 to the exterior 120 of the sub 10 through ports 14.

The interior diameter of the tubular member 12 is characterized by two different diameters, one on either side of ports 14. The diameter of the bore at 52 is less than the diameter of the bore at 54. Accordingly, the cooperating exterior surface of the piston 40 is characterized by a greater diameter at 42 than the diameter at 41. Therefore, the area of the working surface 58 is greater than the area of the working surface 56 and the pressure within the interior 20 of the sub 10 produces a net force acting on the piston 40 across the working surfaces 56, 58 tending to actuate the valve to its open position. When the net force produced by the pressure acting on the surfaces 56, 58 is sufficiently great to overcome the biassing force applied by the C-spring 72 to the bosses 67 and detent 68, the valve opens.

The tubing drain valve sub 10 of the present invention further comprises mechanical means for positively closing the ports 14. The presently preferred embodiment includes lever means which are actuated by an engaging means affixed to a sucker rod 22 for moving the piston 40 to its closed position. The engaging means is conveniently provided by a plurality of interconnected devices, e.g., two semi-cylindrical members 36 interconnected about a sucker rod 22 as by screws 94 in recesses 38. The engaging means is characterized by having a surface 90 capable of engaging the lever means.

Figure 3:
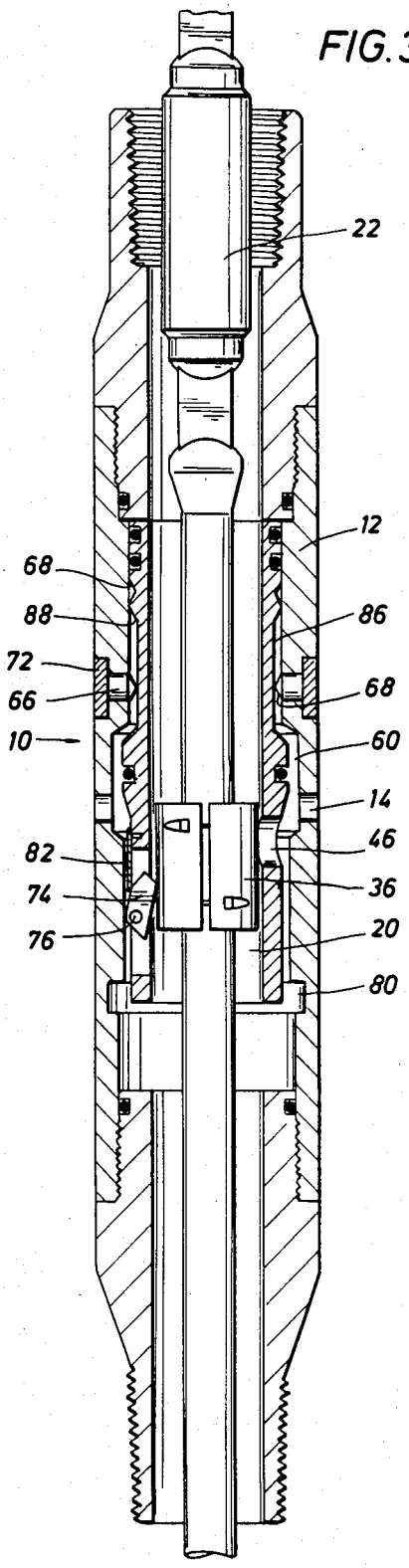
FIG. 3 is a cross-sectional illustration of a sub including a tubing drain valve in accord with the present invention in an open position and wherein the engaging device on a sucker rod is being pulled upward through the sub.

In a presently preferred embodiment, the lever means is provided by one or more dogs 74 pivotally mounted about axles 76 within recesses or openings 78 in the piston 40. See FIGS. 7 and 9 which illustrate a presently preferred embodiment comprising three dogs 74 symmetrically located about the piston 40. When the piston 40 is in the closed position, the dog 74 preferably do not project within the central bore 20 defined by diameter 17 of the pipe string. However, as the piston 40 is opened, one end 75 of the dog 74 engages a surface 92 of a detent 80 in the tubular member 12, causing the dog 74 to rotate about its mounting axle 76 to the position illustrated in FIG. 5. However, a leaf spring 82 attached as at 84 to the piston 40 and projecting into the opening 78 is positioned to cause the opposite end 73 of the dog 74 to remain projecting within the central bore 20 of the sub 10. However, the spring 82 gives under pressure of dog 74 when forced by the engaging device 36 or other objects being raised through the sub, e.g., a downhole pump being pulled, permitting the dog 74 to retract within the opening 78, freeing the central bore 20 for unobstructed passage as illustrated in FIG. 3.

The valve of the present invention is easily closed by mechanical means by lowering an engaging means such as device 36 through the central bore 20. The device 36 is characterized by an engaging surface 90 for engaging the surface 96 of the arm 73 of the dog 74 projecting into the central bore 20 by the action of the spring 82 and the shape of the dog 74. As the engaging device 36 is lowered, the dog 74 pulls the piston 40 toward its closed position. As the piston passes the location illustrated in FIG. 5, the dog 74 becomes free to rotate about its axle 76 directing the arm 75 into the detent 80. As this rotation continues, the end of the arm 75 contacts the surface 92 of the detent 80 causing the dog 74 to act as a lever to pull the piston 40 downward. This downward motion pulls the boss 67 of the plug 66 along the surface 88. When the downward force applied by the engaging device 36 is sufficiently great to overcome the biassing force of the C-spring 72, the plugs 66 are forced outwardly over the surface 88 until maximum expansion is reached at point 89. As point 89 is passed, the biassing force applied by the C-spring 72 drives the boss 67 into the groove 68, further driving the piston 40 into its locked position.

It is believed that those skilled in the art will fully understand the operation of the valve of the present invention based on the above description. However, the method for operating a valve means in accord with the present invention will be briefly summarized below. This method applies to the operation of a valve means comprising a tubular piston 40 movable within a tubular member 12 suitable for use in a borehole pipe string 110 to open and close a port 14 through the wall of the tubular member 12. The method comprises applying a first biassing force to maintain the valve means in its closed position, applying pressure to develop a sufficient force across the working surfaces 56, 58 of the piston 40 to overcome the first biassing force and to actuate the valve means to its open position and, finally, applying sufficient force by mechanical means to the piston 40 to actuate the valve means to its closed position.

The first biassing force is preferably applied by a C-spring 72 to a cooperating boss 67 and detent 68 arrangement as described above. Accordingly, by choosing a C-spring 72 of appropriate strength, it is possible to apply any desired biassing force. The opening force is conveniently developed by increasing the pressure in the interior 20 of the piston 40 and the tubular member 12 to a pressure sufficient to produce the required force. This force is produced by the interior pressure acting upon the working surfaces 56, 58 of the piston 40 by well known principles. In a presently preferred method, the strength of the C-spring 72 is chosen so that the valve means does not open until the interior pressure exceeds the maximum expected working pressure in the pipe string 110 by about 1000 psi.

The method of the present invention further comprises applying a second biassing force when the valve means is in its open position to maintain the valve means in its open position. In a presently preferred method, this second biassing force is applied by a cooperating boss, detent and C-spring arrangement as previously discussed. In fact, in a presently preferred embodiment, the same C-spring 72 and boss 67 merely cooperate with another detent 86 to provide this force.

The presently preferred method for actuating the valve of the present invention to its closed position comprises engaging a lever means on the piston 40 to apply a sufficient force to overcome the second biassing force to actuate the valve means to its closed position. In the presently preferred embodiment, a first arm 73 of a dog 74 pivotally mounted on the piston 40 is engaged with an engaging device 36 insertable through the interior of the tubular piston 12. The engaging device 36 is preferably an engaging surface of a device attached to a sucker rod 22 for operating the downhole pump 114. The method further comprises moving the piston 40 relative to the tubular member 12 to a position where the dog 74 is capable of rotating about its pivot 76 to bring a second arm 75 of the dog 74 into contact with a detent 80 on the tubular member 12. Finally, sufficient force is applied to the first arm 73 by the engaging means 36 to continue rotation of the dog 74 about its pivot 76 while the second arm 75 of the dog 74 engages the detent 80 in order to overcome the second biassing force to actuate the valve to its closed position.

The apparatus and method of the present invention provide a tubing drain valve biassed to both its opened and its closed positions. The tubing drain valve of the present invention is actuated to its opened position when the force developed by the pressure on the interior of the pipe string across the working surfaces of the valve piston is greater than the force biassing the valve to its closed position. The tubing drain valve of the present invention is actuated to its closed position when the force applied by a mechanical means, preferably a mechanically actuated lever means, is greater than the force applied by the means biassing the valve to its open position.

The present invention provides a valve actuated from the surface, preferably pressure opened and mechanically closed. The valve of the present invention remains open after the force applied to open the valve has been removed. A valve in accord with the present invention is conveniently employed in a production string to drain the production fluid therefrom prior to pulling the downhole pump for repairs or the like. This valve greatly reduces the difficultly associated with pulling the downhole pump for repairs by reducing the weight to be pulled. Further, this valve is useful for injecting chemicals into the formation at the location of the valve by permitting the production fluid to be drained from the pipe string and the fluid or chemicals to be directly injected through the pipe string and valve into the formation. Finally, this valve is particularly useful for removing paraffin, wax and other deposits from the interior of a production string by permitting the production fluid to be drained therefrom and hot water or steam to be injected directly into the pipe string at the surface to dissolve the deposits. This system greatly reduces the quantities of fluids, chemicals, hot water or steam necessary for the above operations. These exemplary uses and advantages derived from the valve of the present invention are not meant to be exhaustive or complete but are merely illustrative.

The foregoing description of the invention has been directed in primary part to a particular preferred embodiment and method in accordance with the requirements of the patent statutes and for purposes of explanation and illustration. It will be apparent, however, to those skilled in the art that many modifications and changes in the specifically described apparatus and method may be made without departing from the scope and spirit of the invention. Those skillled in the art will be able to apply the required biassing and operating force by many means. For example, the boss 67 of the tubular member 12 and the detent 68 of the piston 40 are conveniently interchangeable. Further, it will be apparent to those skilled in the art that it is not necessary to include the port 46 within the piston 40, but any means for communicating fluid from the interior to the exterior of piston 40 will be sufficient, e.g., around end 44 or through openings 78. Therefore, the invention is not restricted to the particular form of construction and method illustrated and described, but covers all modifications which may fall within the scope of the following claims.

It is applicant's intention in the following claims to cover such modifications and variations as fall within the true spirit and scope of the invention.

What is claimed is:

1. A method for operating a valve means, said valve means comprising a tubular piston movable within a tubular member suitable for use in a borehole pipe string to open and close a port through the wall of said tubular member, comprising the steps of:

biassing said valve means in its closed position;

pressurizing the interior of said piston to a predetermined pressure to overcome the biassing closed force and to actuate said valve means to its open position;

biassing said valve means to its open position; and actuating said valve means to its closed position by engaging a first arm of a dog pivotally mounted on said piston with an engaging means insertable through the interior of said tubular piston;

moving said piston relative to said tubular member;

rotating said dog about its pivot to bring a second arm of said dog into contact with a detent in said tubular member; and applying sufficient force to said first arm to continue rotating said dog about said pivot, while engaging said detent with said second arm of said dog, in order to overcome the biassing open force to actuate said valve means to its closed position.

2. The method of claim 1 comprising applying said biassing closed and open forces by the same means.

3. The method of claim 1 comprising engaging said dog with an engaging device on a sucker rod disposed on a string of sucker rods.

4. The method of claim 1 comprising engaging a plurality of said dogs.

5. The method of claim 1 further comprising injecting fluid through said port while said valve is in the open position.

6. The method of claim 1 comprising applying said biassing closed force by urging into engagement on said piston and member a cooperating boss and detent.

7. The method of claim 6 comprising urging said boss and detent into engagement with a C-spring.

8. A tubing drain valve suitable for use in a borehole pipe string, comprising:

a sub suitable for incorporating within a borehole pipe string;

a port between the interior and the exterior of said sub; and valve means for opening and closing said port wherein said valve means comprises a tubular piston movable within said sub and having an exterior adapted for sealing cooperation with the interior of said sub and having working surfaces in pressure communication with the interior of said pipe string;

means for communicating fluid from the interior to the exterior of said piston to permit fluid communication through said port from the interior to the exterior of said sub when said valve means is in its open position;

means for biassing said piston to its closed position;

means for actuating said valve means to its open position in response to a pressure force developed across said working surfaces by the pressure in the interior of said sub; and lever means for actuating said valve means to its closed position in response to an actuating device movable through said pipe string, wherein said lever means comprises a dog having first and second arms pivotally mounted at a rotation/fulcrum point on said piston;

said dog engageable on said first arm by said actuating device; and said dog engageable on said second arm with a surface of said sub to urge said valve means to its closed position.

9. The tubing drain valve of claim 8 further comprising means for biassing said piston to its open position.

10. The tubing drain valve of claim 8 wherein said valve means comprises means for actuating said valve means to its open postition when the pressure in the interior of said sub exceeds a predetermined pressure.

11. The tubing drain valve of claim 8 comprising means for actuating said piston to its open position when said force developed across said working surfaces exceeds the force applied by said biassing means.

12. The tubing drain valve of claim 8 further comprising on said sub and said piston a cooperating boss and detent to maintain said valve means in its closed position when urged into cooperation by said biassing means.

13. The tubing drain valve of claim 12 further comprising a second detent for cooperation with said boss to maintain said valve means in its open position when urged into cooperation by said biassing means.

14. The tubing drain valve of claim 13 wherein said biassing means comprises a C-spring to urge said boss into cooperation with said detents.

15. A sub including a tubing drain valve suitable for use in a borehole pipe string, comprising:

a tubular member adapted to be incorporated in a pipe string;

a fluid passage through the wall of said tubular member;

valve means to open and close said passage, comprising:

a tubular piston having an exterior adjusted for sealing cooperation with the interior of said tubular member and having working surfaces in pressure communcation with the interior of said sub;

means for communicating fluid from the interior to the exterior of said piston to permit fluid communication through said passage from the interior to the exterior of said tubular member when said valve means is in its open position;

means for biassing said tubular piston to its closed position;

means for actuating said valve means to its open position in response to a pressure force developed across said working surfaces by the pressure in the interior of said sub; and lever means for actuating said valve means to its closed position in response to an actuating device movable through said pipe string, wherein said lever means comprises a dog having first and second arms pivotally mounted at a rotation/fulcrum point on said piston;

said dog engageable on said first arm by said actuating device;

said dog engageable on said second arm with a surface of said sub to urge said valve means to its closed position.

16. A pipe string system suitable for use in a borehole, comprising:

a plurality of tubular members interconnected to form a pipe string;

a sub incorporated in said pipe string;

a port between the interior and the exterior of said sub;

valve means for opening and closing said port wherein said valve means comprises a tubular piston movable within said sub having an exterior adapted for sealing cooperation with the interior of said sub and having working surfaces in pressure communication with the interior of said pipe string;

means for communicating fluid from the interior to the exterior of said piston to permit fluid communication through said port from the interior to the exterior of said sub when said valve means is in its open position;

means for biasing said piston to its closed position;

means for actuating said valve means to its open position in response to a pressure force developed across said working surfaces by the pressure in the interior of said sub; and lever means for actuating said valve means to its closed position in response to an actuating device movable through said pipe string, wherein said lever means comprises a dog having first and second arms pivotally mounted at a rotation/fulcrum point on said piston;

said dog engageable on said first arm by said actuating device; and said dog engageable on said second arm with a surface of said sub to urge said valve means to its closed position;

means for pressurizing the interior of said sub to a pressure sufficient to develop the force necessary to actuate the valve to its open position; and means insertable through said pipe string to mechanically actuate said valve to its closed position.

17. The pipe string system of claim 16 further comprising means for injecting fluid into the interior of said pipe string while said valve is in the open position.

18. The pipe string system of claim 16 of claim 12 wherein the interior diameter of said sub and valve is at least as great as the interior diameter of said tubular members.

19. The pipe string system of claim 18 wherein said dog projects into the space defined by the internal diameter of said pipe string only when said valve is in its open position, said dog being retractable to permit objects substantially as large as said internal diameter to move longitudinally through said sub, and said dog including surfaces for engagement by said mechanical means to actuate said valve to its closed position.

20. The pipe string comprising means for operating system of claim 16 wherein said insertable means from the surface.

21. The pipe string system of claim 20 wherein said insertable means is an engaging device on a string of sucker rods.

* * * * *

UNITED STATES PATENT AND TRADEMARK OFFICE

CERTIFICATE OF CORRECTION

PATENT NO. : 4,645,007

DATED : February 24, 1987

INVENTOR(S) : Paul B. Soderberg

It is certified that error appears in the above-identified patent and that said Letters Patent are hereby corrected as shown below:

Column 10, line 48, delete "adjusted" and insert therefor --adapted--.

Column 12, line 19, delete "of claim 12";
line 31, after "string" insert --system of claim 16--; and
line 32, delete "system of claim 16 wherein".

Signed and Sealed this

Sixth Day of October, 1987

*Attest:*

DONALD J. QUIGG

*Attesting Officer*

*Commissioner of Patents and Trademarks*